US010556331B2

(12) United States Patent
Chien

(10) Patent No.: US 10,556,331 B2
(45) Date of Patent: Feb. 11, 2020

(54) IMPACT DEVICE FOR AN ELECTRIC NAIL GUN

(71) Applicant: Basso Industry Corp., Taichung (TW)

(72) Inventor: Chia-Yu Chien, Taichung (TW)

(73) Assignee: Basso Industry Corp., Taichung (TW)

( * ) Notice: Subject to any disclaimer, the term of this patent is extended or adjusted under 35 U.S.C. 154(b) by 220 days.

(21) Appl. No.: 15/871,718

(22) Filed: Jan. 15, 2018

(65) Prior Publication Data

US 2018/0200873 A1 Jul. 19, 2018

(30) Foreign Application Priority Data

Jan. 19, 2017 (TW) ..... 106101827 A

(51) Int. Cl.
*B25C 1/06* (2006.01)

(52) U.S. Cl.
CPC ..... *B25C 1/06* (2013.01)

(58) Field of Classification Search
CPC ..... B25C 1/06; B25D 1/005; B25D 11/00
USPC ..... 227/133
See application file for complete search history.

(56) References Cited

U.S. PATENT DOCUMENTS 7,204,403 B2 * 4/2007 Kenney ..... B25C 1/06 227/120
7,905,377 B2 * 3/2011 Krondorfer ..... B25C 1/06 173/117
8,231,039 B2 * 7/2012 Buck ..... B25C 1/06 227/120
8,453,901 B2 * 6/2013 Suda ..... B25C 1/06 227/117
8,511,532 B2 * 8/2013 Chien ..... B25C 1/06 227/120
9,346,157 B2 * 5/2016 Morioka ..... B25C 1/003
9,868,196 B2 * 1/2018 Chien ..... B25C 1/047
2005/0218181 A1 * 10/2005 Gross ..... B25C 1/06 227/130
2006/0261125 A1 * 11/2006 Schiestl ..... B25C 1/06 227/131

(Continued)

FOREIGN PATENT DOCUMENTS

EP 2644323 A2 10/2013
EP 2711135 A2 3/2014
TW I385059 B1 2/2013

OTHER PUBLICATIONS

Search Report issued to European counterpart application No. 18152298.8 by the EPO dated Jun. 18, 2018.

*Primary Examiner* — Andrew M Tecco
*Assistant Examiner* — Eyamindae C Jallow
(74) *Attorney, Agent, or Firm* — MLO, a professional corp.

(57) ABSTRACT

An impact device for an electric nail gun having a flywheel includes a swing arm unit and an impact unit. The impact unit includes an impact member adapted to be disposed between the flywheel and the swing arm unit, and a magnetic element set mounted to the impact member, spaced apart from the swing arm unit to form a gap therebetween, and providing a magnetic force which magnetically attracts a magnetically conductive component of the swing arm unit. The swing arm unit is movable between a pre-firing position where the impact member is not in contact with the flywheel, and a firing position where the impact member is in contact with the flywheel such that rotation of the flywheel drives the impact unit to move on the swing arm unit.

10 Claims, 10 Drawing Sheets

(56) References Cited

U.S. PATENT DOCUMENTS

| | | | | |
|---|---|---|---|---|
| 2006/0261126 | A1* | 11/2006 | Schiestl | B25C 1/06 227/131 |
| 2009/0032566 | A1* | 2/2009 | Liang | B25C 1/06 227/131 |
| 2009/0032567 | A1* | 2/2009 | Liang | B25C 1/06 227/131 |
| 2009/0194573 | A1* | 8/2009 | Liang | B25C 1/06 227/131 |
| 2010/0038395 | A1 | 2/2010 | Krondorfer et al. | |
| 2010/0038397 | A1* | 2/2010 | Krondorfer | B25C 1/06 227/8 |
| 2013/0255984 | A1* | 10/2013 | Po | B25C 1/06 173/112 |
| 2015/0251300 | A1* | 9/2015 | Po | B25C 1/06 227/132 |
| 2015/0306753 | A1* | 10/2015 | Po | B25C 1/008 227/109 |

* cited by examiner

IMPACT DEVICE FOR AN ELECTRIC NAIL GUN

CROSS-REFERENCE TO RELATED APPLICATION

This application claims priority of Taiwanese Patent Application No. 106101827, filed on Jan. 19, 2017.

FIELD

The disclosure relates to an impact device, and more particularly to an impact device for an electric nail gun.

BACKGROUND

FIG. 1 shows a conventional electric nail gun 1 disclosed in Taiwanese Invention Patent No. 1385059. The conventional electric nail gun 1 includes a supporting bracket 11, a flywheel 12 rotatably disposed on the supporting bracket 11 and capable of being electrically driven to rotate, a swing arm 13 pivotally disposed on the supporting bracket 11 and movable toward or away from the flywheel 12, a guiding rod 14 co-movably connected to the swing arm 13 and extending in a nail-striking direction (Y), an impact member 15 in contact with and slidable along the guiding rod 14, and two sliding wheels 16 rotatably disposed on the impact member 15 and in rolling contact with the swing arm 13. When the swing arm 13 is moved toward the flywheel 12 by an external force and the impact member 15 contacts the flywheel 12, the impact member 15 slides at a high speed along the guiding rod 14 in the nail-striking direction (Y) for performing a nail-striking operation.

The sliding wheels 16 improve smoothness in movement of the impact member 15 along the guiding rod 14. However, since the impact member 15 and the guiding rod 14 are in physical contact with each other, frictional resistance is generated between the impact member 15 and the guiding rod 14 during the sliding movement of the impact member 15. Therefore, there is still room for improving the smoothness of the movement of the impact member 15.

SUMMARY

Therefore, an object of the disclosure is to provide an impact device that can alleviate at least one of the drawbacks of the prior art.

According to the disclosure, the impact device is for an electric nail gun which includes a supporting bracket and a flywheel that is rotatably disposed on the supporting bracket and that is capable of being electrically driven to rotate. The impact device includes a swing arm unit and an impact unit.

The swing arm unit is adapted to be pivotally disposed on the supporting bracket, and includes a magnetically conductive component that is magnetically conductive. The impact unit includes an impact member that is adapted to be disposed between the flywheel and the swing arm unit, and a magnetic element set that is mounted to the impact member, that is spaced apart from the swing arm unit to form a gap therebetween, and that provides a magnetic force which magnetically attracts the magnetically conductive component so that the impact unit is in contact with the swing arm unit.

The swing arm unit is movable between a pre-firing position, where the impact member is not in contact with the flywheel, and a firing position, where the impact member is in contact with the flywheel such that rotation of the flywheel drives the impact unit to move on the swing arm unit in a nail-striking direction for performing a nail striking operation.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
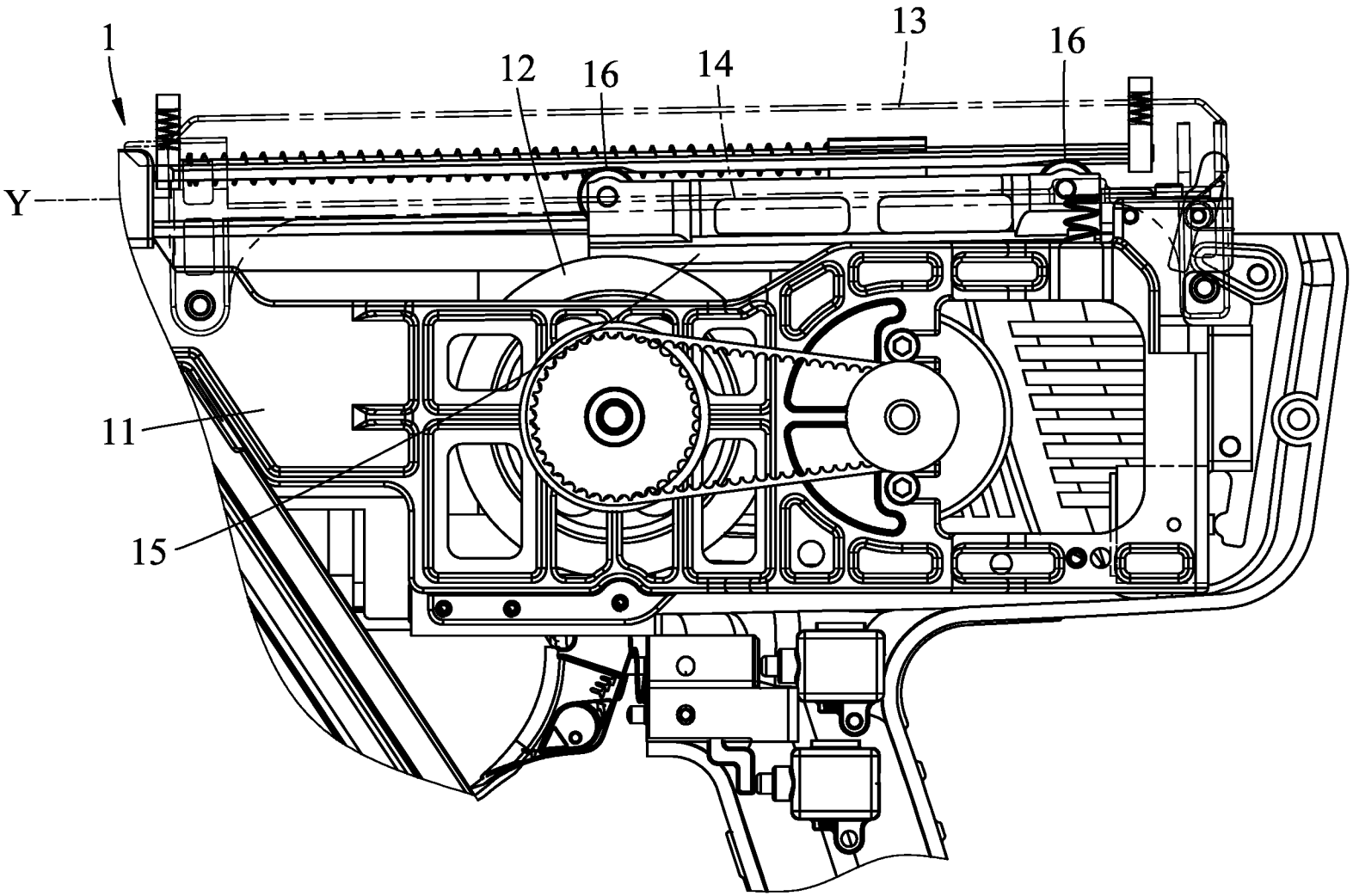
FIG.1 PRIOR ART
FIG. 1 is a fragmentary front view illustrating a conventional electric nail gun disclosed in Taiwanese Patent No. I385059.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
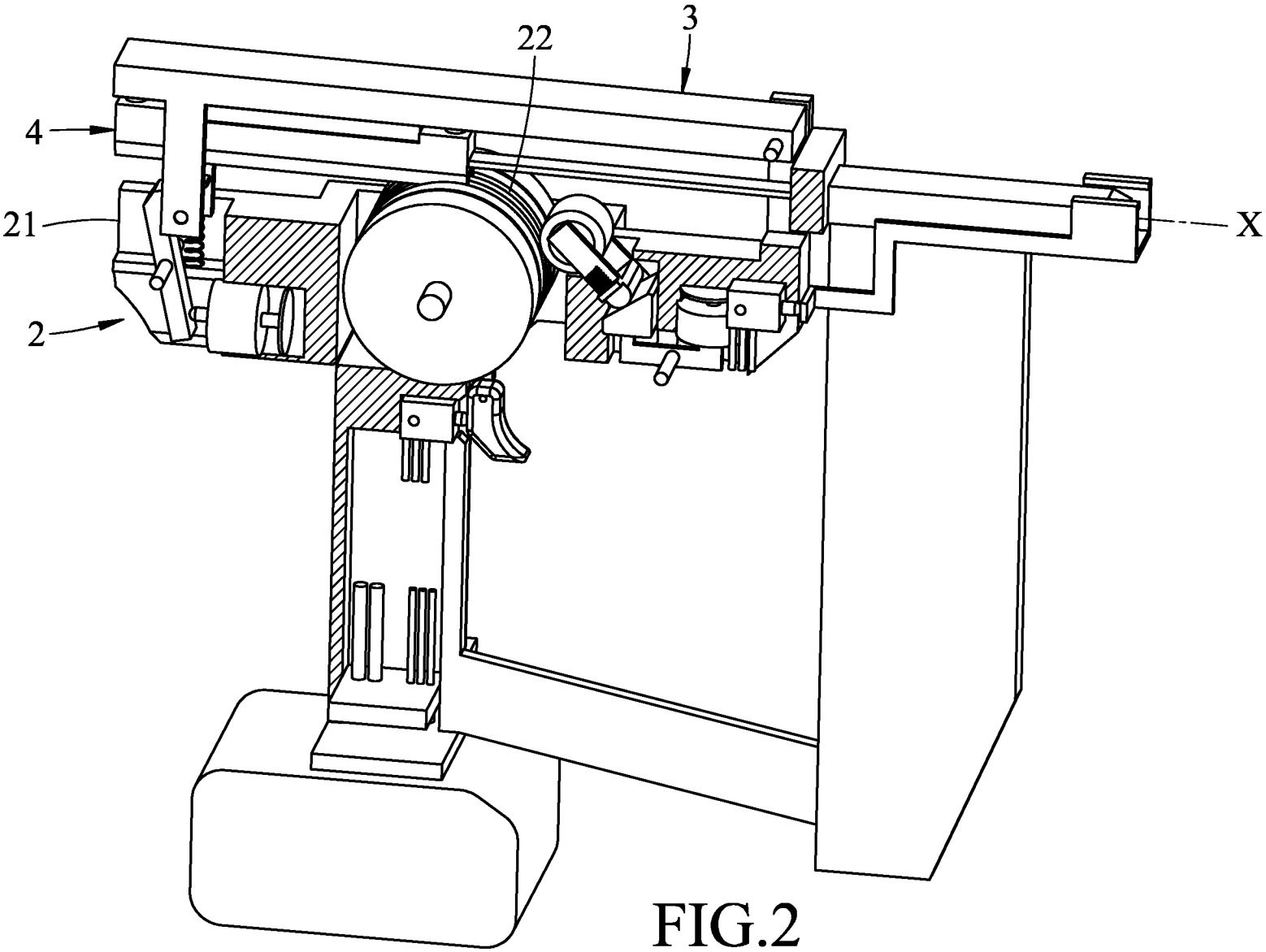
FIG. 2 is a schematic partly sectional view illustrating an electric nail gun including a first embodiment of an impact device according to the disclosure.
Figure 3:
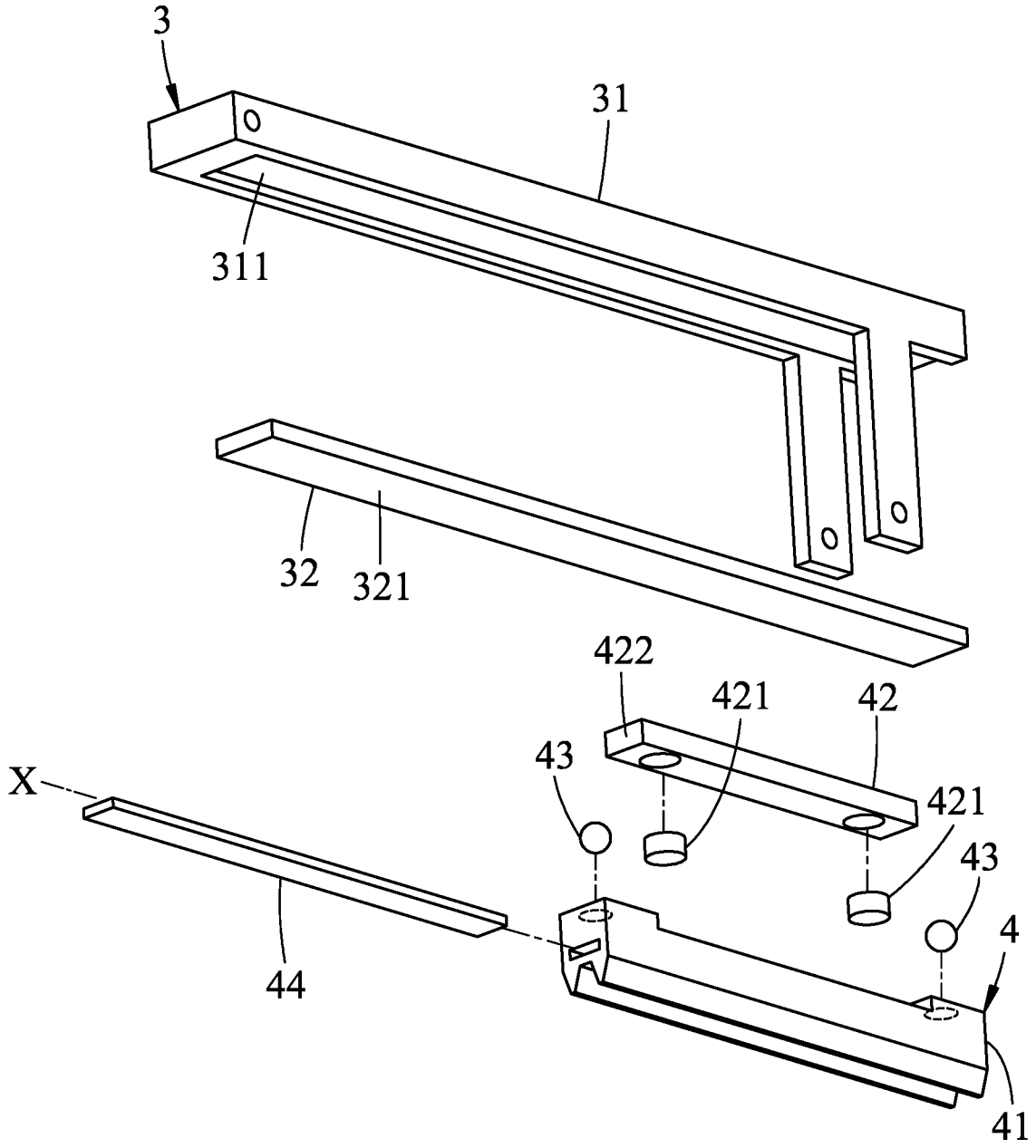
FIG. 3 is an exploded perspective view illustrating the first embodiment.
Figure 4:
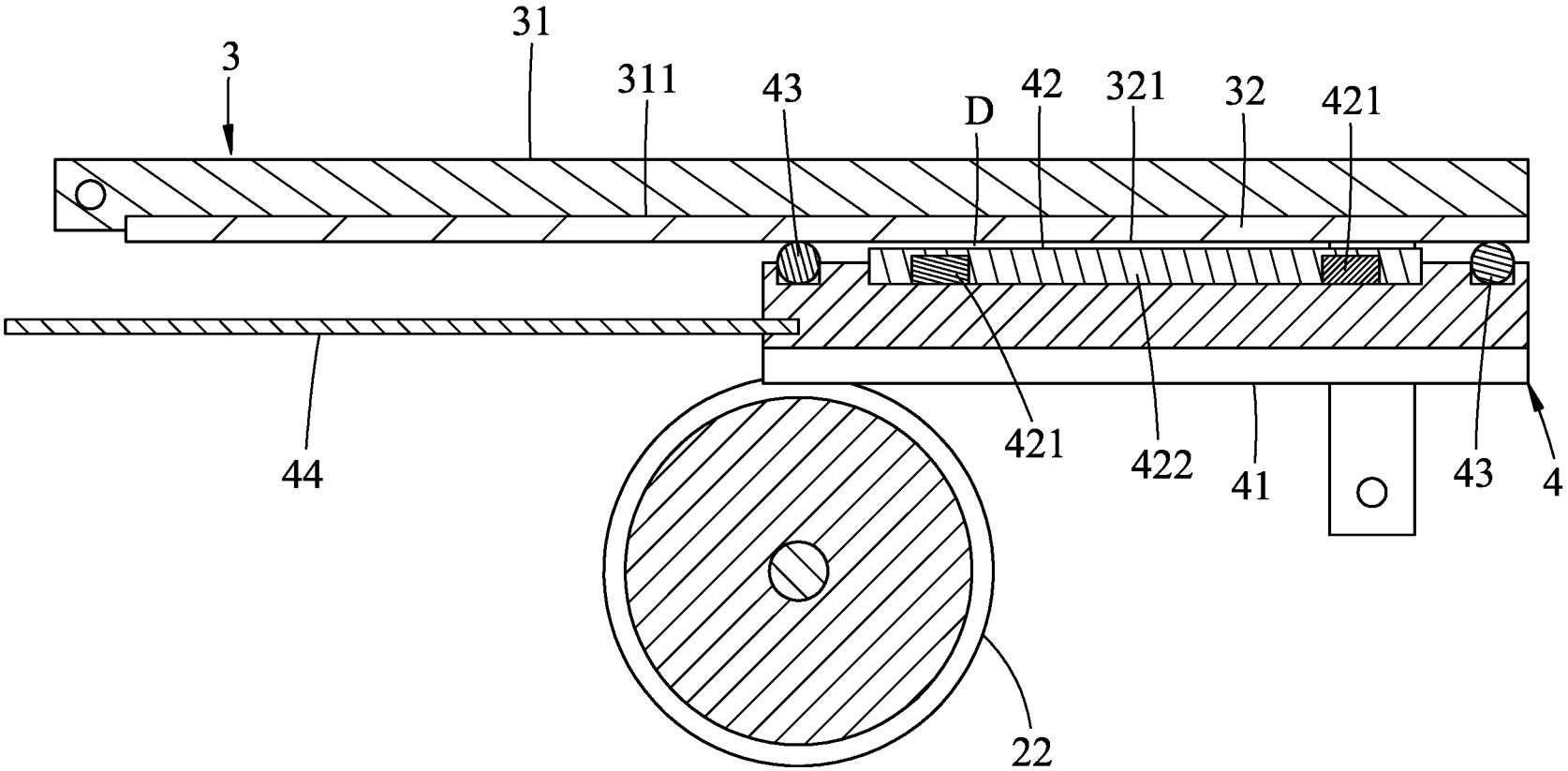
FIG. 4 is a schematic sectional view of the first embodiment, illustrating a swing arm unit at a pre-firing position.
Figure 5:
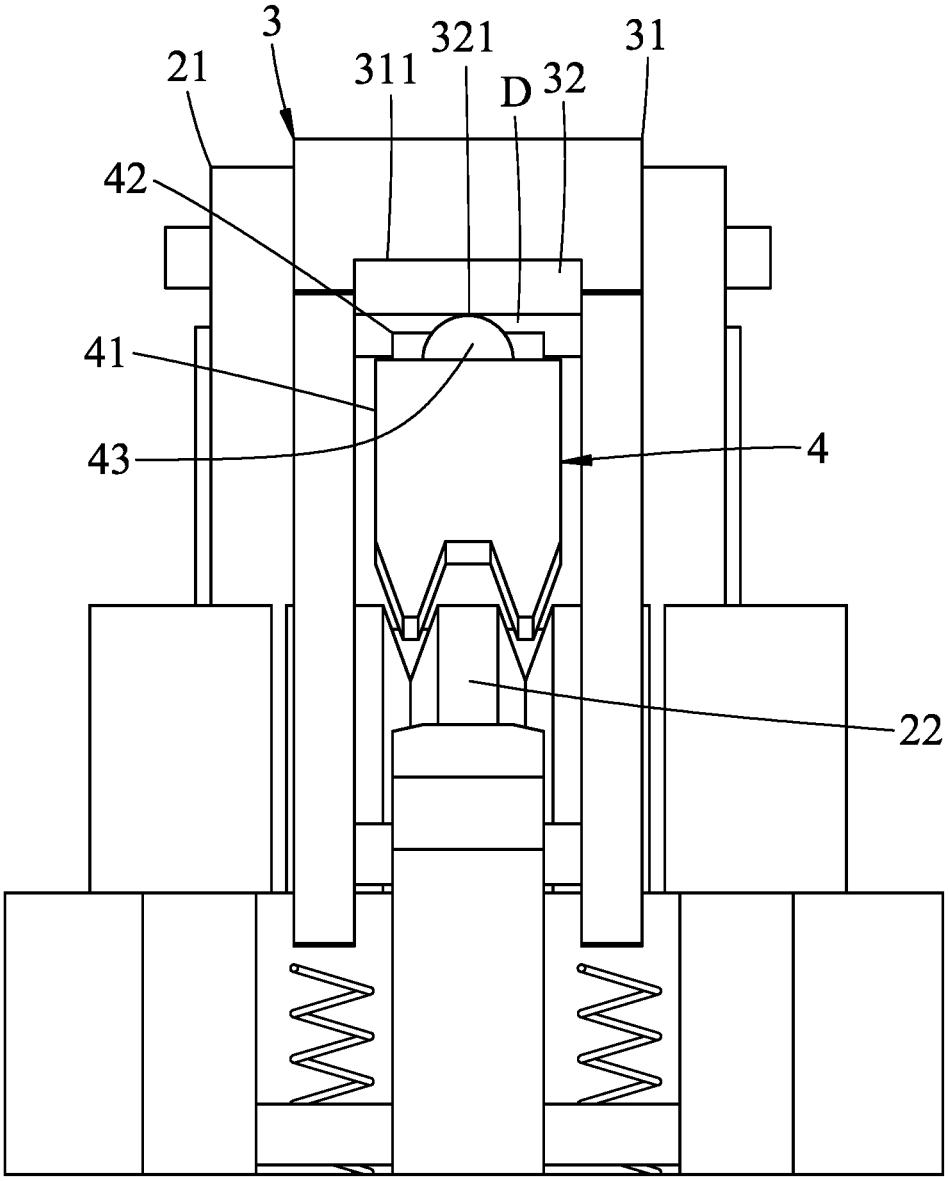
FIG. 5 is a fragmentary schematic side view illustrating the swing arm unit at the pre-firing position with a gap formed between an impact unit of the first embodiment and a flywheel of the electric nail gun.
Figure 6:
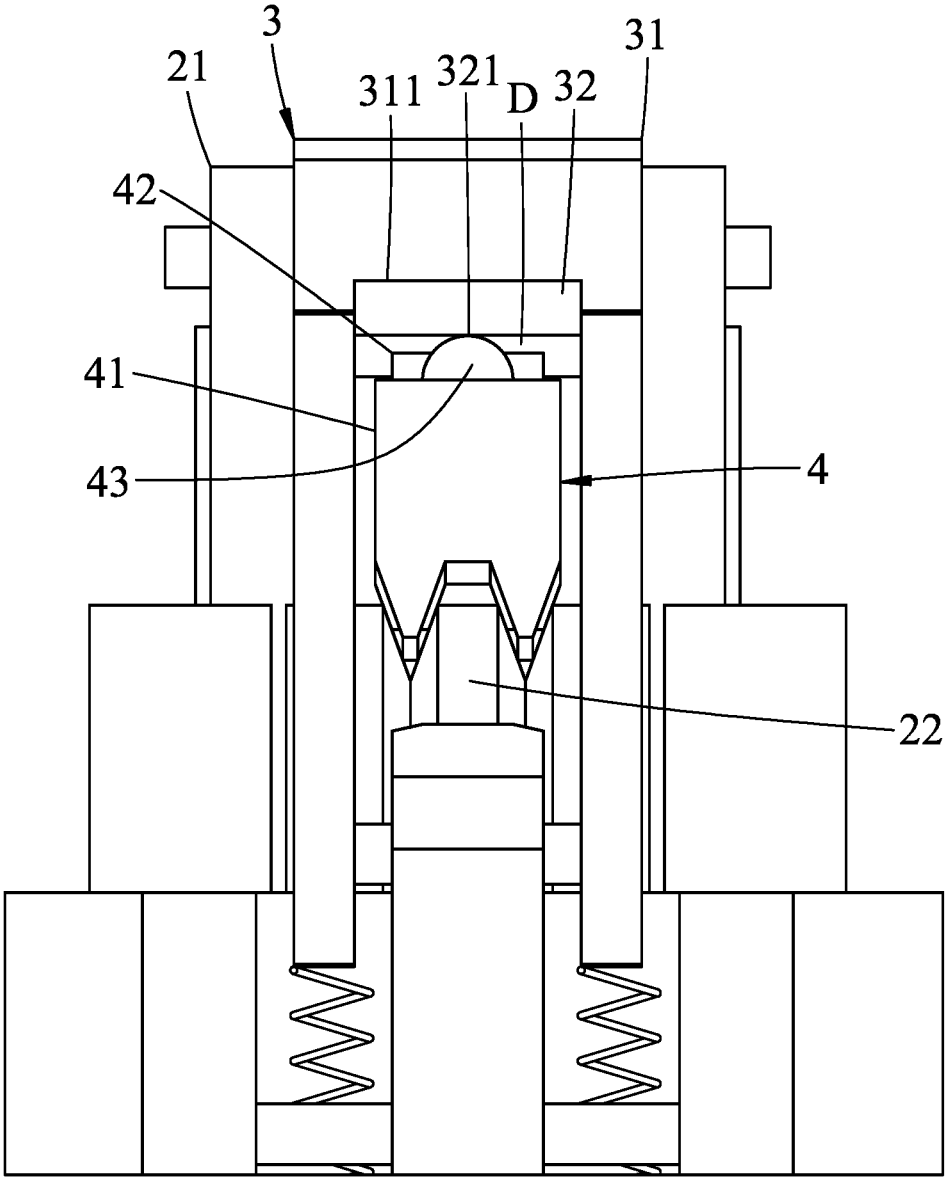
FIG. 6 is a view similar to FIG. 5, but illustrating the swing arm unit at a firing position with the impact unit contacting the flywheel.
Figure 7:
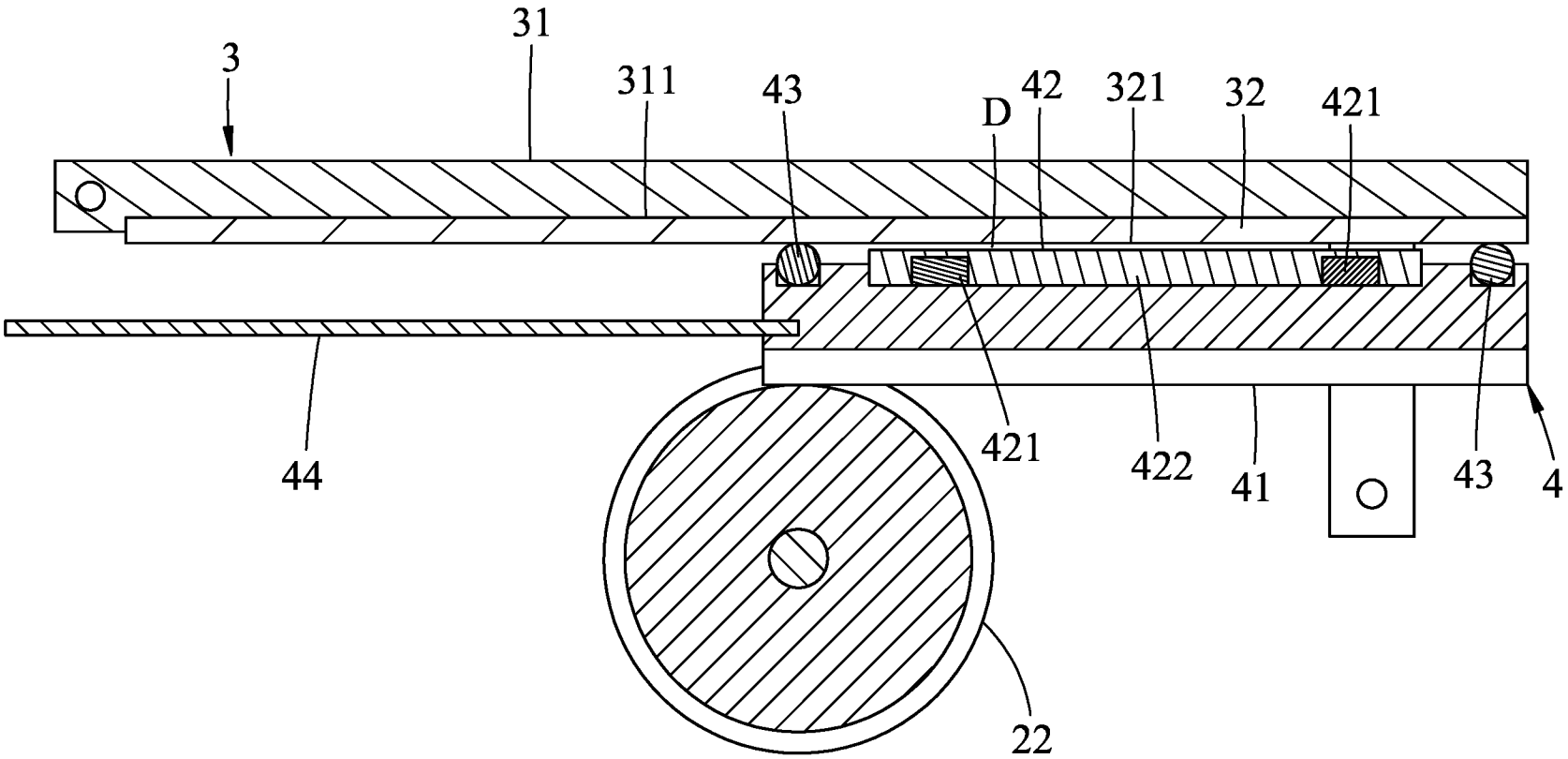
FIG. 7 is a view similar to FIG. 4, but illustrating the swing arm unit at the firing position.

Referring to FIGS. 2 to 4, a first embodiment of an impact device according to the disclosure is adapted to be mounted in an electric nail gun 2. The electric nail gun 2 includes a supporting bracket 21 and a flywheel 22 that is rotatably disposed on the supporting bracket 21 and that is capable of being electrically driven to rotate. The impact device includes a swing arm unit 3 and an impact unit 4.

The swing arm unit 3 is adapted to be pivotally disposed on the supporting bracket 21, and includes a swing arm 31 that extends in a nail-striking direction (X), and a magnetically conductive component 32 that is magnetically conductive. The swing arm 31 has an inner surface 311 facing the flywheel 22. The magnetically conductive component 32 is disposed on the inner surface 311 of the swing arm 31 and extends in the nail-striking direction (X). The magnetically conductive component 32 has a slide surface 321 extending in the nail-striking direction (X) and facing the flywheel 22.

In this embodiment, the impact unit 4 includes an impact member 41, a magnetic element set 42, two rolling members 43, and a nail-striking rod 44.

The impact member 41 is adapted to be disposed between the flywheel 22 and the swing arm unit 3 with the inner surface 311 of the swing arm 31 facing the impact member 41.

The magnetic element set 42 is mounted to the impact member 41, is spaced apart from the swing arm unit 3 to form a gap (D) therebetween, and provides a magnetic force which magnetically attracts the magnetically conductive component 32 so that the impact unit 4 is coupled to and in contact with the swing arm unit 3.

In this embodiment, the magnetic element set 42 includes two magnetic elements 421 that are disposed on the impact member 41 and that are spaced apart from each other in the nail-striking direction (X), and a retaining member 422 that is fastened to the impact member 41 to retain the magnetic elements 421 on the impact member 41. The retaining member 422 covers the magnetic elements 421. The gap (D) is formed between the retaining member 422 and the magnetically conductive component 32.

The rolling members 43 are spaced apart from each other, and are respectively and rotatably disposed at opposite end portions of the impact member 41. The rolling members 43 are in rolling contact with the slide surface 321 of the magnetically conductive component 32 of the swing arm unit 3, and refrain the impact member 41 from contacting the slide surface 321, so that the gap (D) is formed and maintained between the magnetically conductive component 32 of the swing arm unit 3 and the retaining member 422 of the magnetic element set 42. In this embodiment, each of the rolling members 43 is ball-shaped, but the shape of the rolling members 43 is not limited thereto. In other embodiments, each of the rolling members 43 may be a hollow cylinder or a solid cylinder that is rollably disposed on the impact member 41.

It should be noted that the design of the rolling members 43 in rolling contact with the slide surface 321 of the magnetically conductive component 32 provides smoothness in movement of the impact member 41 on the swing arm unit 3. In addition, the rolling members 43 serve to prevent direct contact between the magnetically conductive component 32 and the magnetic element set 42. In this way, the magnetic element set 42 is physically separated from and not in contact with the magnetically conductive component 32, yet the magnetic attraction between the magnetic element set 42 and the magnetically conductive component 32 permits the impact unit 4 to be co-rotatably coupled to the swing arm unit 3.

The nail-striking rod 44 extends from the impact member 41 in the nail-striking direction (X).

Referring to FIGS. 4 to 7, the swing arm unit 3 is movable between a pre-firing position (see FIGS. 4 and 5), where the swing arm unit 3 is moved away from the flywheel 22 such that the impact member 41 is not in contact with the flywheel 22, and a firing position (see FIGS. 6 and 7), where the swing arm unit 3 is moved toward the flywheel 22 such that the impact member 41 is in contact with the flywheel 22, and that rotation of the flywheel 22 drives the impact unit 4 to move on the swing arm unit 3 (i.e., by the rolling members 43 rolling on the slide surface 321 of the magnetically conductive component 32) in the nail-striking direction (X) for performing a nail striking operation.

Figure 8:
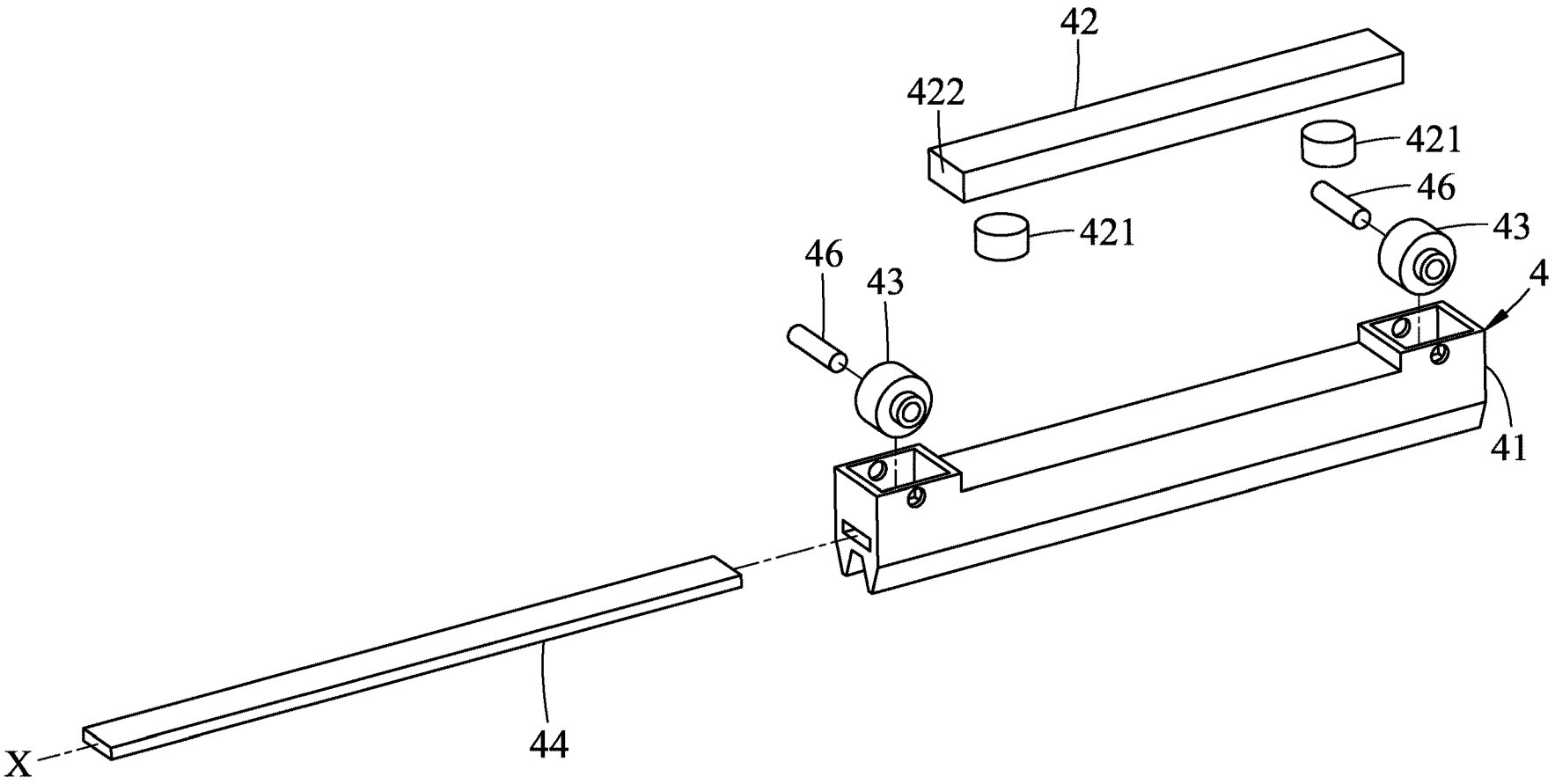
FIG. 8 is an exploded perspective view illustrating a second embodiment of the impact device according to the disclosure.

Referring to FIG. 8, a second embodiment of the impact device according to the disclosure is similar to the first embodiment, and the difference between the first and second embodiments resides in the impact unit 4. In the second embodiment, the rolling members 43 are configured as rolling wheels, and the impact unit 4 further includes two axles 46 that are mounted to the impact member 41 and that respectively extend through the rolling members 43, such that each rolling member 43 is rotatable about a respective one of the axles 46.

Figure 9:
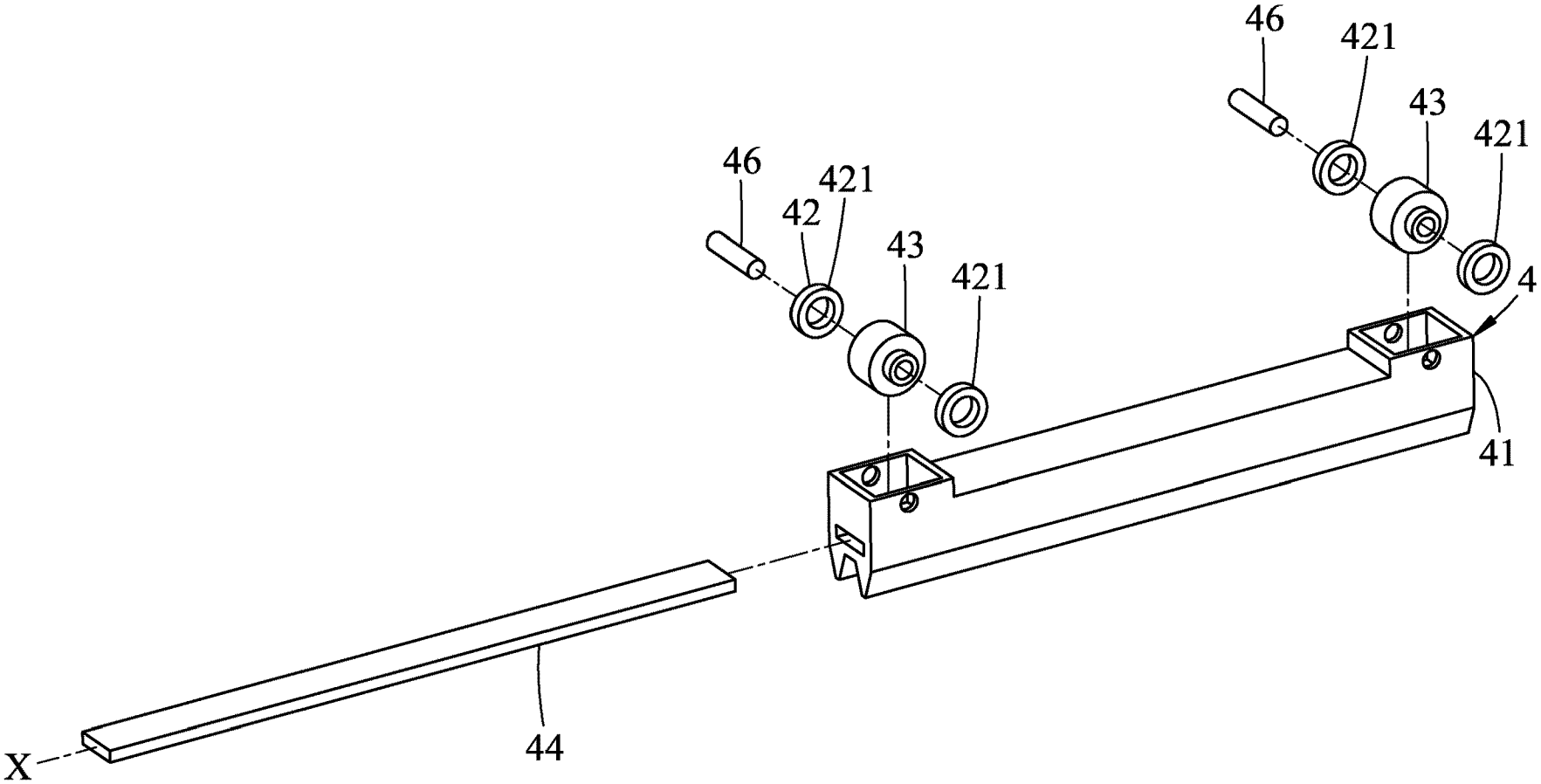
FIG. 9 is an exploded perspective view illustrating a third embodiment of the impact device according to the disclosure.
Figure 10:
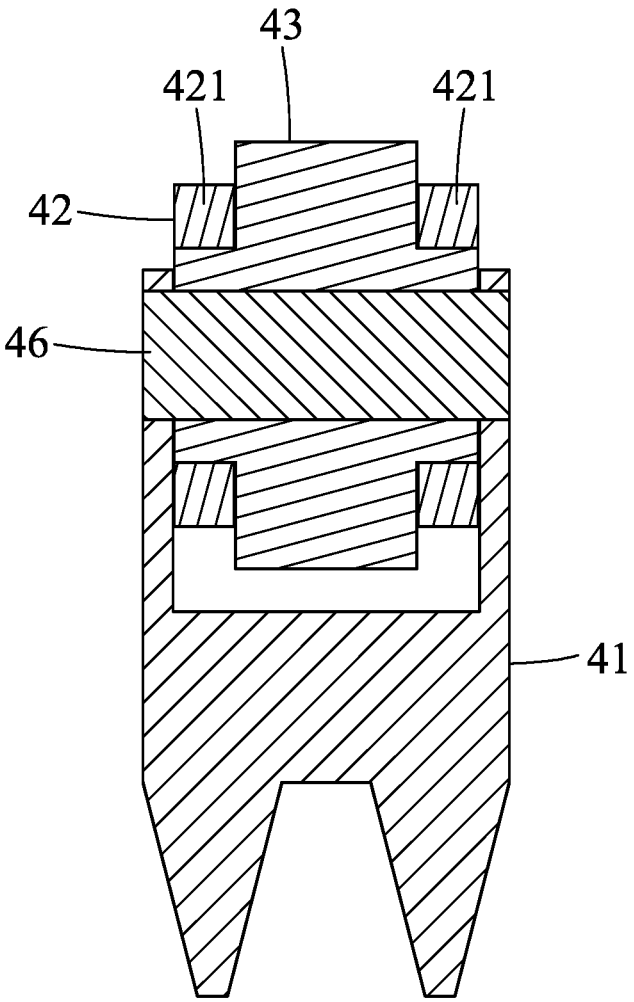
FIG. 10 is a schematic sectional view of the third embodiment.

Referring to FIGS. 9 and 10, a third embodiment of the impact device according to the disclosure is similar to the second embodiment. The difference between the second and third embodiment resides in the magnetic element set 42. The magnetic element set 42 of the third embodiment includes four magnetic elements 421 that are paired up, and each of the magnetic elements 421 is ring-shaped. Two of the magnetic elements 421 are respectively disposed at opposite sides of one of the rolling members 43, and one of the axles 46 extends through the two of the magnetic elements 421. The other two of the magnetic elements 421 are respectively disposed at opposite sides of the other one of the rolling members 43, and the other one of the axles 46 extends through the other two of the magnetic elements 421. The axles 46 serve to retain the magnetic elements 421, and each of the rolling members 43 has an outer diameter greater than that of each of the magnetic elements 421 so as to form the gap (D).

In summary, since the swing arm unit 3 and the impact unit 4 are coupled via the magnetic attraction between the magnetically conductive component 32 and the magnetic elements 421, frictional resistance during movement of the impact member 41 on the swing arm unit 3 is greatly reduced in comparison with the above-mentioned prior art, thereby significantly improving smoothness in the movement of the impact member 41 when a nail-striking operation is performed.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An impact device for an electric nail gun, the electric nail gun including a supporting bracket and a flywheel that is rotatably disposed on the supporting bracket and that is capable of being electrically driven to rotate, said impact device comprising:

a swing arm unit adapted to be pivotally disposed on the supporting bracket, and including a magnetically conductive component that is magnetically conductive; and an impact unit including an impact member that is adapted to be disposed between the flywheel and said swing arm unit, and a magnetic element set that is mounted to said impact member, that is spaced apart from said swing arm unit to form a gap therebetween, and that provides a magnetic force which magnetically attracts said magnetically conductive component so that said impact unit is in contact with said swing arm unit;

wherein, said swing arm unit is movable between a pre-firing position, where said impact member is not in contact with the flywheel, and a firing position, where said impact member is in contact with the flywheel such that rotation of the flywheel drives said impact unit to move on said swing arm unit in a nail-striking direction for performing a nail striking operation.

2. The impact device as claimed in claim 1, wherein said impact unit further includes at least one rolling member that is rotatably disposed on said impact member, that is in rolling contact with said swing arm unit, and that is disposed to form said gap between said swing arm unit and said magnetic element set.

3. The impact device as claimed in claim 2, wherein said impact unit includes two of said rolling members that are spaced apart from each other and that are respectively and rotatably disposed at opposite end portions of said impact member.

4. The impact device as claimed in claim 2, wherein said impact unit includes two of said rolling members that are spaced apart from each other, and two axles that are mounted to said impact member and that respectively extend through said rolling members, such that each rolling member is rotatable about a respective one of said axles.

5. The impact device as claimed in claim 4, wherein:

said magnetic element set includes four magnetic elements, two of said magnetic elements being respectively disposed at opposite sides of one of said rolling members, one of said axles extending through said two of said magnetic elements, the other two of said magnetic elements being respectively disposed at opposite sides of the other one of said rolling members, the other one of said axles extending through said other two of said magnetic elements; and each of said rolling members has an outer diameter greater than that of each of said magnetic elements so as to form said gap.

6. The impact device as claimed in claim 4, wherein said magnetically conductive component has a slide surface extending in the nail-striking direction and facing the flywheel, said rolling members being in rolling contact with said slide surface and refraining said impact member from contacting said slide surface.

7. The impact device as claimed in claim 2, wherein said magnetically conductive component has a slide surface extending in the nail-striking direction and facing the flywheel, said at least one rolling member being in rolling contact with said slide surface and refraining said impact member from contacting said slide surface.

8. The impact device as claimed in claim 1, wherein said swing arm unit further includes a swing arm that has an inner surface facing said impact member, said magnetically conductive component being disposed on said inner surface of said swing arm and extending in the nail-striking direction.

9. The impact device as claimed in claim 1, wherein said magnetic element set includes at least one magnetic element that is disposed on said impact member, and a retaining member that is fastened to said impact member to retain said at least one magnetic element on said impact member.

10. The impact device as claimed in claim 9, wherein said retaining member covers said at least one magnetic element, said gap being formed between said retaining member and said magnetically conductive component.

* * * * *